United States Patent [19]

Cherry

[11] 4,002,867

[45] Jan. 11, 1977

[54] VACUUM-TYPE CIRCUIT INTERRUPTERS WITH CONDENSING SHIELD AT A FIXED POTENTIAL RELATIVE TO THE CONTACTS

[75] Inventor: Sidney J. Cherry, Elmira, N.Y.

[73] Assignee: Westinghouse Electric Corporation, Pittsburgh, Pa.

[22] Filed: Sept. 23, 1974

[21] Appl. No.: 508,373

Related U.S. Application Data

[63] Continuation-in-part of Ser. No. 302,952, Nov. 1, 1972, abandoned.

[52] U.S. Cl. ..... 200/144 B; 200/144 AP

[51] Int. Cl.[2] ..... H01H 33/66

[58] Field of Search ..... 200/144 B, 144 AP

[56] References Cited

UNITED STATES PATENTS

| | | | |
|---|---|---|---|
| 2,453,555 | 11/1948 | Thommen | 200/146 R |
| 3,147,356 | 9/1964 | Luehring | 200/144 B |
| 3,160,727 | 12/1964 | Colclaser, Jr. et al. | 200/144 AP |
| 3,541,284 | 11/1970 | Wachta | 200/144 B |
| 3,708,638 | 1/1973 | Mitchell | 200/144 B |

FOREIGN PATENTS OR APPLICATIONS

| | | | |
|---|---|---|---|
| 1,126,053 | 9/1968 | United Kingdom | 200/144 B |

*Primary Examiner*—Robert S. Macon
*Attorney, Agent, or Firm*—Willard R. Crout

[57] ABSTRACT

A vacuum-type circuit interrupter has a condensing shield which is maintained at a predetermined potential relevant to the separable contacts by the use of resistance means, which are tapped off to the condensing shield. The resistance means may assume either the form of a surface coating with a preselected resistance on the inside or the outside of the insulating envelope casing, or the resistance means could be a ceramic envelope casing having a preselected volume resistance. Additionally, the use of coatings of metals and/or semiconductors on the inside and/or the outside of the insulating envelope casing may be used to obtain the desired preselected surface resistance values. Even external circuitry, connected to the condensing shield and the contacts, may be used to achieve the proper resistance values.

The foregoing arrangements prevent the condensing shield from "floating" in potential value relevant to the separable electrodes, and gives rise to desirable results.

7 Claims, 20 Drawing Figures

ARC VOLTAGE DISTRIBUTION

ARCING PHASE

POST ARC RECOVERY PHASE

POSITIVE 10μS
PLASMA

POSITIVE 10μS
PLASMA

POSITIVE 10μS
PLASMA
DISTANCE
VOLTAGE
+
0
−
GROUND
RECOVER VOLTAGE
t = 30μS t = 15μS

RECOVERY VOLTAGE
t = 7μS

VACUUM-TYPE CIRCUIT INTERRUPTERS WITH CONDENSING SHIELD AT A FIXED POTENTIAL RELATIVE TO THE CONTACTS

This patent application is a continuation-in-part patent application of parent patent application filed Nov. 1, 1972, Ser. No. 302,952 (now abandoned) and assigned to the assignee of the instant patent application.

CROSS-REFERENCE TO RELATED APPLICATIONS

Applicant is not aware of any related application which is pertinent to the present invention.

BACKGROUND OF THE INVENTION

Users of vacuum-type interrupters do not attach any fixed potential, or any circuit connections to the condensing shield of a vacuum-type circuit interrupter. Instead, they allow the condensing shield to electrically "float," i.e., assume a potential that is dependent upon its capacitance, the unpredictable low surface leakage of the insulators, or casing separating it from the other electrodes or contacts, and electrons and/or ions which strike it. Because of the erratic nature of these effects, a definite potential on the condensing shield is not always possible.

SUMMARY OF THE INVENTION

According to a preferred embodiment of the invention, a vacuum-type circuit interrupter has a condensing shield, which is maintained at a predetermined voltage potential relevent to the separable electrodes, or contacts by the use of a surface coating having a preselected resistance, which coating covers the outside or inside of the cylindrical ceramic casing or envelope of the vacuum interrupter.

External circuitry to provide the resistance values, or in certain case glazes may be utilized. Preferably, the resistance value is between $10^6$ ohms and $10^{12}$ ohms in value. A resistance R may be provided between a floating condensing shield and either or both of the contacts of the unit.

BRIEF DESCRIPTION OF THE DRAWINGS

Referring to the drawings, and more particularly to FIG. 1 thereof, the reference numeral 1 generally designates a vacuum-type interrupter comprising a pair of separable electrodes of contacts 2, 3, which engage in the closed-circuit position of the device, as illustrated in FIG. 1. With reference to FIG. 2, it will be apparent that the stationary contact or electrodes 2 is supported on a stationary contact post 4, the latter being secured, as by brazing 5, to a lower-disposed cup-shaped condensing shield 6. Cooperable with the relatively stationary contact structure 2 is the movable contact structure 3, which is illustrated more clearly in FIG. 3 of the drawings. As shown in FIG. 3, it will be noted that a resilient bellows 7 has one end 7*a* secured, as by brazing, to a shoulder portion 10*a* of the movable contact supporting rod 10. The other end 7*b* of the resilent bellows 7 is secured, as by brazing, to the inner surface of an aperture 12 provided through the upper end plate 13 of the circuit interrupter 1. Also FIG. 3 shows in more detail a cup-shaped condensing shield 15, which serves to condense vaporized metal emitted from the contact structure 2, 3 during arcing conditions from reaching the inner wall surfaces 18*a*, 19*a* of the outer surrounding cylindrical casing-sections 18, 19.

FIG. 1 shows the central generally cylindrically-shaped condensing shield 22, which is supported by a center flange ring 23, the latter being illustrated more clearly in FIGS. 4 and 5 of the drawings. It will be observed that the center flange 23 has an annular portion 23*a*, which is interposed between the confronting end surfaces 18*b*, 19*b* of the envelope sections 18, 19. Additionally, the center flange 23 has axially-extending tabs 23*b*, integrally formed therewith, which are secured, as by brazing, to the central portion 22*a* of the main condensing shield 22 to fixedly support the same.

With reference to FIG. 1, it will be observed that the center condensing shield 22 cooperates with the opposed end cup-shaped condensing shields 6, 15 to force metallic vapor to take a circuituous path before being able to reach the inner surfaces, such as 18*a*, 19*a*, of the envelope sections 18, 19.

Figure 1:
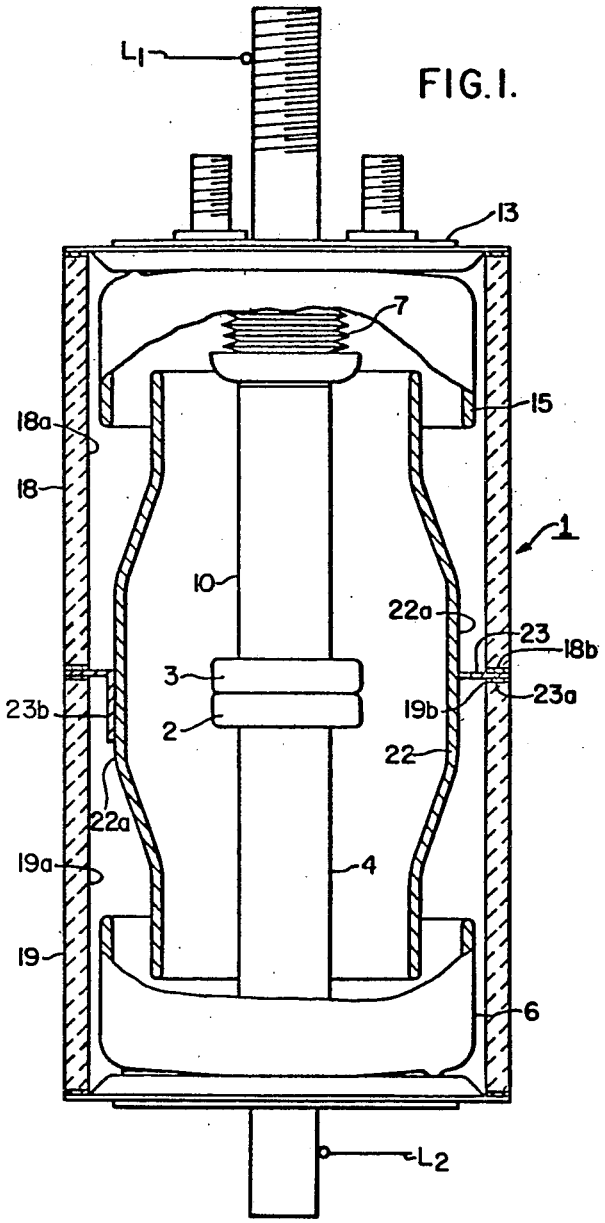
FIG. 1 is a vertical sectional view taken through a vacuum-type circuit interrupter embodying the principles of the present invention, and illustrating the separable contacts in the closed-circuit position.
Figure 3:
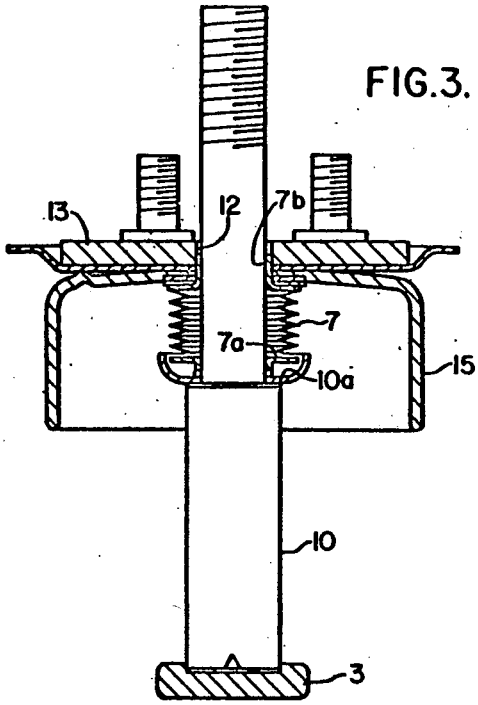
FIG. 3 is a vertical sectional view taken through a subassembly of the movable contact assembly.
Figure 2:
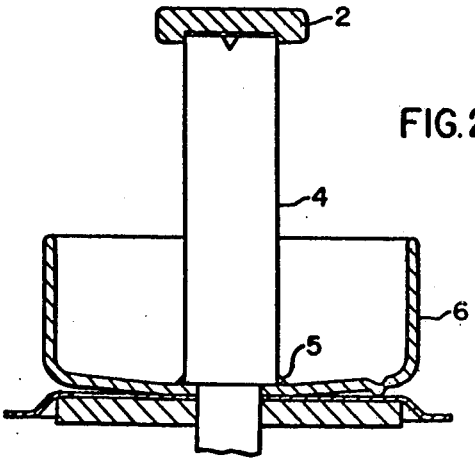
FIG. 2 is a vertical sectional view taken through a subassembly of the stationary contact, or electrode of the vacuum-type circuit interrupter of FIG. 1.
Figure 4:
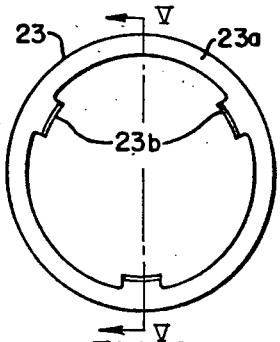
FIGS. 4 and 5 are top plan and side sectional views of the metallic center supporting flange for the condensing shield.
Figure 5:
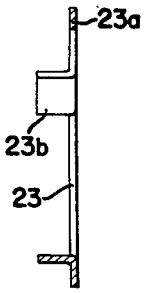

As well known by those skilled in the art, the users of vacuum interrupters do not attain any fixed potential, or any circuit connections to the central condensing shield of the vacuum interrupter. Instead, they allow the condensing shield to electrically "float," i.e., assume a potential that is dependent on its capacitance, the upredictable low surface leakage of the insulators or casing separating it from other electrodes or contacts, and electrons and/or ions, which strike it.

Vacuum interrupters commonly use an electrically isolated (or floating) shield 22 because under steady state electrical conditions with the contacts 2, 3 open this shield 22 assumes a potential midway between the potential difference between the contacts 2, 3. There is, consequently, less likelihood for an electrical vacuum breakdown between such a shield 22 and one of the contacts than for the construction where the arc shield 22 is connected to one of the contact structures.

Because it is electrically isolated, it is vulnerable to transient charging affects which put the shield 22 at a higher than normal voltage from which it cannot easily recover. As an example, described below, during the post arc recovery period the shield 22 may be locked in at an abnormally high voltage which it cannot quickly discharge.

This invention corrects this problem by providing a rsistance, in effect, between the shield 22 and either or both of the contact structures 2, 3 into which the abnormal shield voltage is quickly discharged. The resistance may take the form of a resistance coating on the inside or outside surface of the insulators separating the arcing shield 22 from the contact structure, having insulator(s) with a small amount of conductivity, or by providing resistors outside of the interrupter between the shield 22 and contact structures 2, 3.

To illustrate the phenomenon consider the interruption of a high arc current 12,000 amp or more where a post arc current may flow. Consider three phases (1) arcing (2) post arcing recovery and (3) the steady state voltage.

Figure 10:
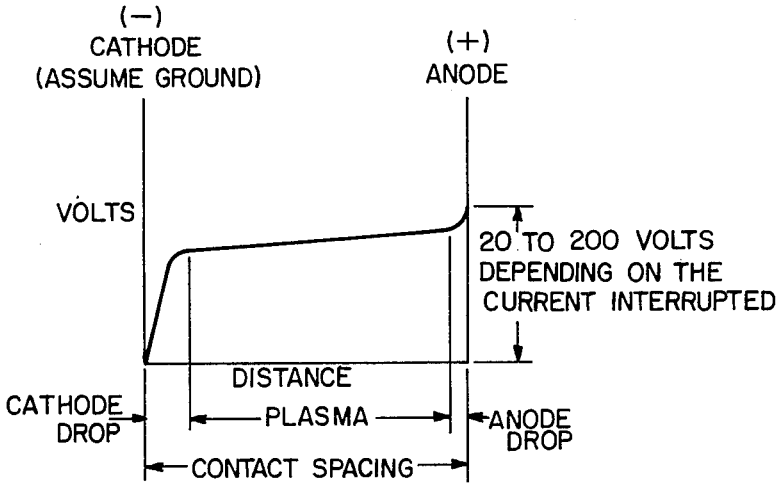
FIGS. 10–15 are graphs and diagrams illustrating the principles of the invention.
Figure 16:
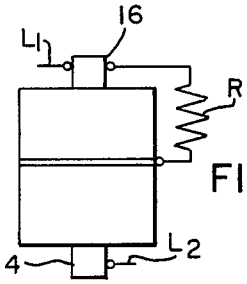
Figure 17:
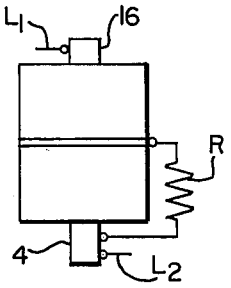
Figure 11:
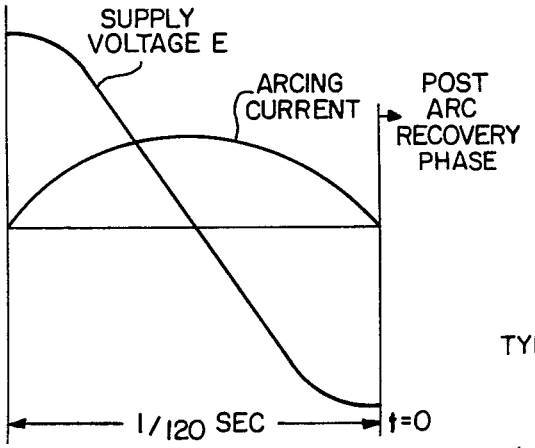

During the arcing phase, the voltage distribution takes the form shown in FIG. 10. Three regions are shown — the cathode drop over a relatively short distance, the plasma region with a small slope, and a relatively small anode voltage drop over a small distance. For all practical purposes the plasma between two conducting surfaces such as the contacts 2, 3 or a vacuum interrupter takes on the potential of the postive surface. Further, since the shield 22 is immersed in the plasma and is electrically isolated, it takes on the potential of plasma. In effect, with a plasma present the shield 22 takes on approximately the potential of the positive contact.

Figure 12:
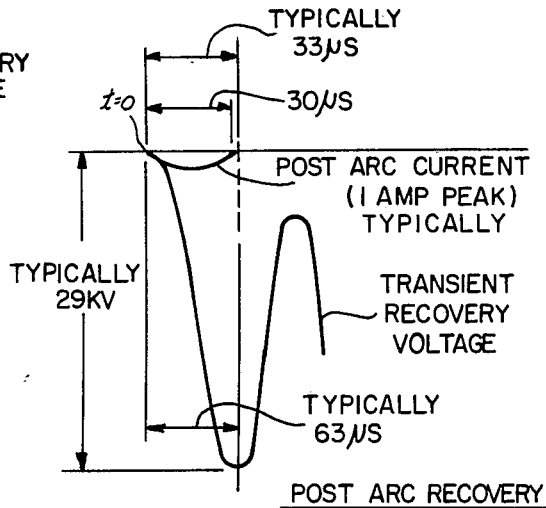
Figures 13A, 13B, 14A, 14B, 15A, 15B:
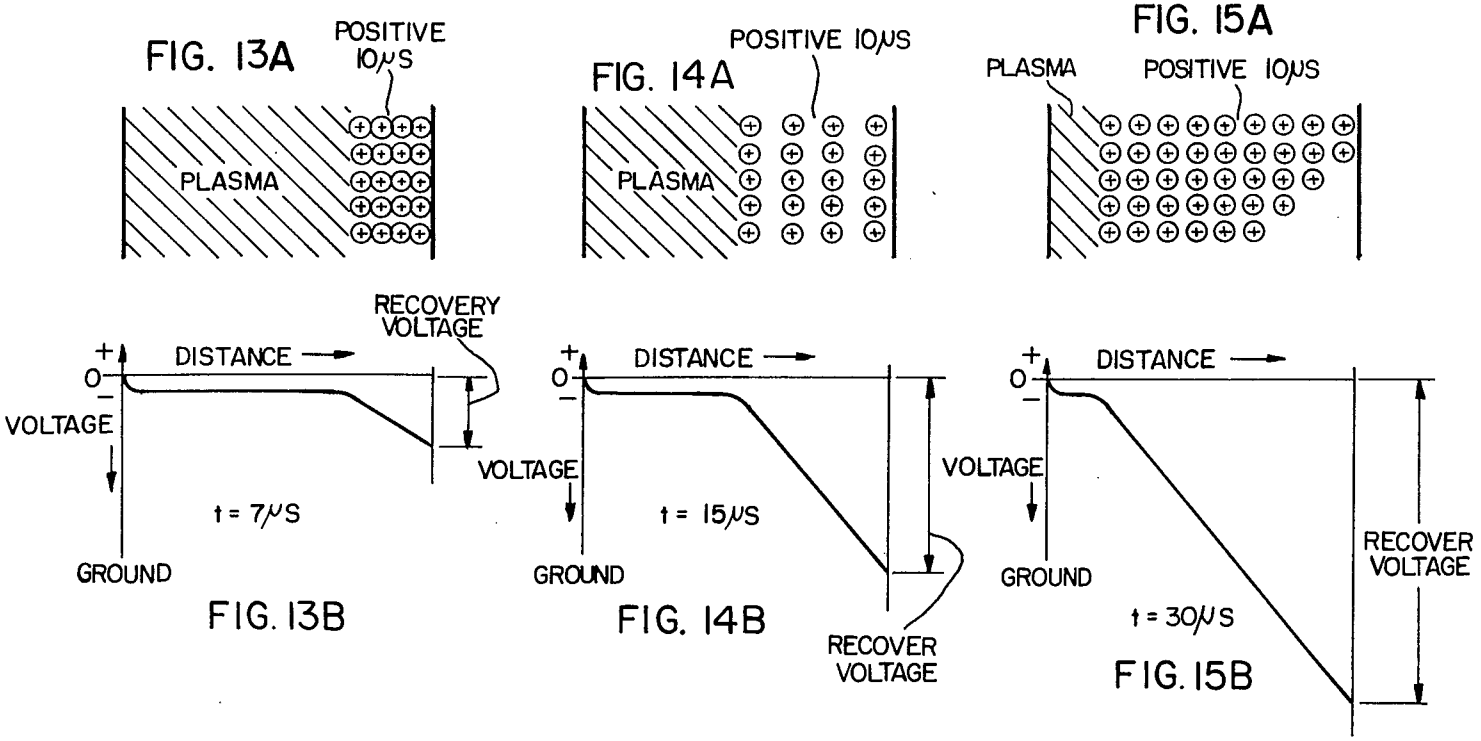

Now consider arcing current post arc recovery period, the time immediately after the arcing current has gone to zero which is depicted in FIG. 12. When the time scale is blown up, a typical current and voltage for the post arc period is shown in FIG. 12. The transient recovery voltage is the result of the circuit phenomena in which the vacuum interrupter is connected. The post arc current, a function of the magnitude of the interrupter current and the vacuum interrupter, results from the decay of the plasma remaining at current zero. The shield 22 as explained earlier takes on the potential of the decaying plasma. But now the plasma, again having the potential of the positive contact, is at ground because the contact which was positive during arcing takes on a negative voltage as shown in FIG. 13. The condition of the receding plasma, and the voltage distribution between the contacts are shown in FIGS. 13–15 for three times. Note that the shield 22 is locked into the potential of the grounded electrode while the plasma is present. When the plasma finally decays to zero, the shield voltage with respect to the negative contact is almost equal to the peak transient recovery voltage. This voltage is much higher than the normal recovery voltage and will remain higher until it can be leaked off the abnormal charge. Since the shield 22 is electrically isolated its leakage is extremely low and the time to restore the shield 22 to normal potential will require many cycles. During this time the shield 22 will be at high voltage and voltage breakdown may occur.

The steady state voltages in the vacuum interrupter with the contacts 2, 3 open is arrived at when the plasma has disappeared and the abnormal charges are dissipated. In this condition the shield 22 has a voltage equal to half of the voltage between the contacts 2, 3. For the $3\phi$ 15.5kV, illustrated above, the normal recovery voltage for the shield 22 would be 6.3kV peak compared with the abnormal shield voltage described above of approximately 29kV peak.

Figure 7:
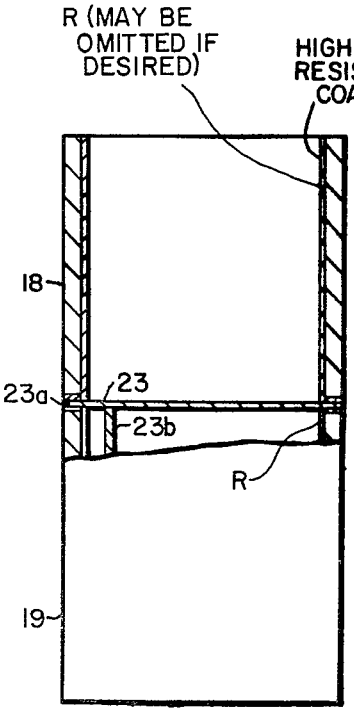
FIGS. 7 and 8 illustrate resustance coatings on the inside and outside surfaces, respectively, of resistance interrupter casings.

With regard to value of the resistance to be used, this depends on the voltage and also whether the resistance element is connected to one or both contacts 2, 3. If it is connected to one contact only, (see FIG. 7 for example) the resistance must not be so low that it compares with the reactance of the shield 22 to contact capacitance because if it does, the shield 22 will not be midway between the voltage across the contacts 2, 3. As an example if the capacitance of the shield 22 to each contact is $10\times10^{-12}$ farads, its reactance is $2.65\times10^{8}$ ohms whence a resistance value should be no less than $10^{9}$ ohm approximately.

On the other hand if resistance elements are connected to each contact structures 2, 3 the potential of the shield will not be affected by the value of resistance. The limiting factor here is the allowable amount of power taken by the resistance element. For example if a limit of 50 watts were set up for each resistive element R (FIG. 7 for example) between the shield and contact, for a 3 phase 15.5 kV system the resistance value would be $0.8\times10^{6}$ ohms. For a 38kV system, the corresponding resistance is $4.8\times10^{6}$ ohms.

Any one of the resistances listed above would be adequate to discharge the abnormal voltage on the shield 22. The discharge time, being related to the RC constant, would for example using the constants listed above be $10^{9}\times10\times10^{-12} = 10^{-2}$ sec for the connection to one contact and $0.8\times10^{6}\times10\times10^{-12} = 0.8\times10^{-6}$ sec for the resistance R (FIG. 7) connected to two contacts 2, 3.

Figure 8:
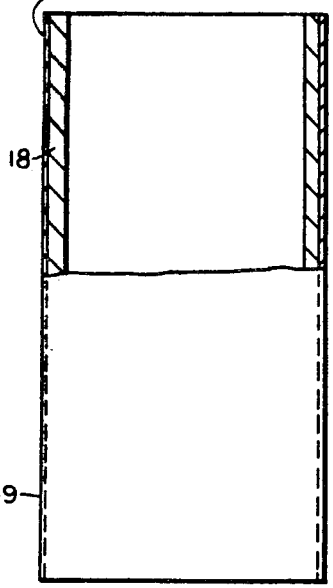
Figure 9:
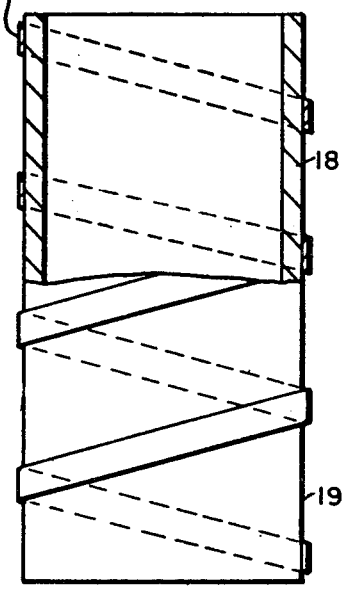
FIG. 9 illustrates a spiral ribbon resistance coating as an alternate embodiment.

My invention proposes that vacuum interrupters be built, with preselected resistances between the center condensing shield 22 and either or both electrodes, or contacts 2, 3 in the vacuum interrupter 1. This may be done by a number of different ways such as:

1. The use of surface coatings with preselected resistance on the inside or the outside, or on both sides, of the insulators, or casing sections 18, 19 as in FIGS. 7 and 8,

2. By using insulators with preselected volume resistances,

3. By the use of coatings of metals, cermets, and/or semiconductors on the inside and/or outside surfaces of the insulator casing to obtain preselected surface resistance,

4. Semiconducting glazes on the insulating casing may be used.

Figure 6:
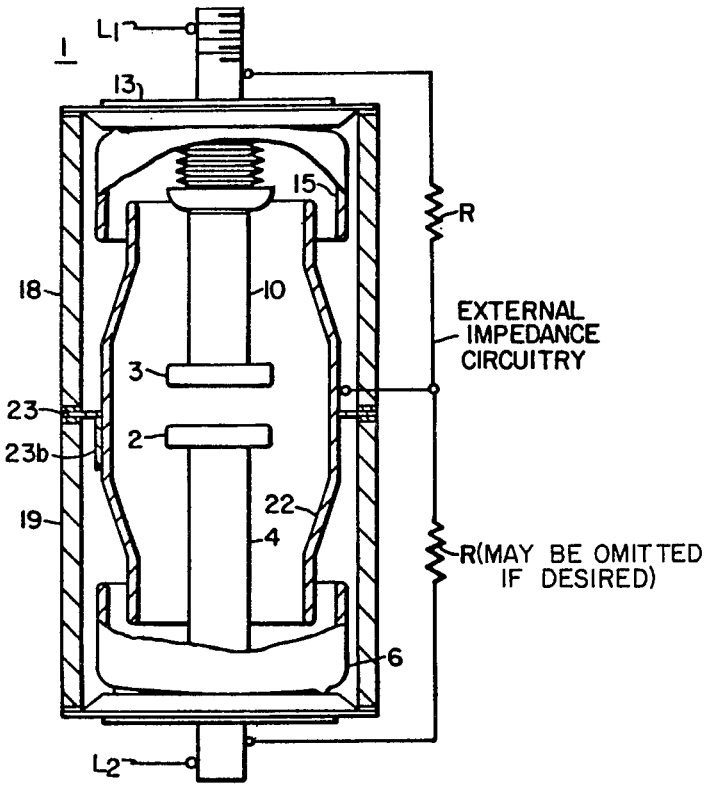
FIG. 6 illustrates sectionally an alternate embodiment of the invention wherein external resistance circuitry is utilized to achieve the desired fixed potential value on the center condensing shield.

Other means of preselecting surface resistances or volume resistances of the insulator sections 18, 19 may occur to those familiar with the art. Finally, external circuits of resistances may be attached to the outside of the vacuum interrupter between the center condensing shield 22 and the other electrodes or contacts 2, 3 as shown in FIG. 6.

Such an arrangement of any one of the above will avoid the condition of a "floating" condensing shield, and will result in predictable potential maintained on the shield 22.

The possibility of having an abnormally high potential on the shield 22 is less likely for a tube with a coated insulator. When the interrupter contacts 2, 3 are open and when no current is flowing, the shield 22 potential is determined by its capacitances to the open contacts 2, 3. But when the interrupter 1 breaks the alternating current, and current flows in the space between the open contacts 2, 3, the shield potential is determined by the plasma set up by the discharge, and not by the capacitances. Since the plasma takes a finite time the deionize after the alternating current goes to zero, the shield 22 potential, following the plasma potential, does not assume its normal potential immediately during the recovery-voltage period. Instead, it must drift to that normal potential through its resistance and its capacitance to the contacts 2, 3. A measure of the time it takes to drift to that potential is the so-called time constant RC.

For a typical vacuum interrupter 1, without a coating on the insulator 18, 19 between the shield 22 and the contacts 2, 3: $R = 10^{14}$ ohms, $C = 10 \times 10^{-12}$ farads, making the time constant $= RC = 10^{3}$ seconds.

For vacuum interrupters with a coating of silicone carbide, for example, on the insulators 18, 19, $R = 10^{9}$, $C = 10 \times 10^{-12}$, making the time constant $RC = 10^{-2}$ sec.

From this, it can be seen that a shield 22 with a coated insulator 18, 19 will have an abnormal shield voltage for much less time. This means that the probability of a restrike between the shield 22 and the contacts 2, 3 during the recovery period is correspondingly lowered.

An example of a suitable resistance coating on the ceramic envelope is as follows:

Silicon Carbide Coating

Materials 60 ml Ethlyl silicate
15 ml 2% HCl
90 ml Dioxane
2.0 gm Bentone 27
1.0 ml 95% Methanol
80 gm SiC (carbontronic: – 6 micron or finer purchased from Carborundum Co.)

Preparation

1. Wash ball mill with acetone and thoroughly air dry.
2. Add Bentone to mill and roll for 5 minutes.
3. Add HCl to Dioxane, followed by Ethyl Silicate and Methanol. (Add Silicate slowly while stirring.)
4. Add liquid to mill.
5. Mill 24 hours.
6. Add SiC and mill for 20 minutes.

Application

1. Rotate part to be coated.
2. Brush inside with above mixture, using a 3 mil fiber nylon brush.
3. Air dry.
4. Fire in an oven at 400° C. for 15 minutes.

A desirable range of resistance would be from $R = 10^{7}$ to $10^{14}$, as set forth in FIG. 6 of the drawings. A more narrow resistance range having very desirable values is $10^{8}$ ohms to $10^{10}$ ohms, with an optimum value of resistance being $10^{8}$ ohms.

From the foregoing, it will be apparent that there has been provided an improved vacuum-type circuit interrupter in which the centrally located condensing shield 22 is at a fixed predetermined potential with respect to the electrodes 2, 3 and line terminals of the vacuum "bottle" 1. In addition, an example of a particular resistance coating has been included to provide a guide as to the proper resistance ranges.

An article giving pertinent information as to resistance glaze coatings is set forth in the May 1964 issue of Electrical Review entitled "Glaze on High-Voltage Insulators" by C. H. W. Clark.

From the foregoing description it will be apparent that there has been provided an improved vacuum-type circuit interrupter 1 in which the condensing shield 22 is maintained at a preselected potential relevant to the separable contacts or electrode structures 2, 3.

Although there have been illustrated and described specific structures, it is to be clearly understood that the same were merely for the purpose of illustration, and that changes and modifications may readily be made therein by those skilled in the art without departing from the spirit and scope of the invention.

I claim:

1. An alternating current circuit interrupter of the vacuum type, including in combination:

a. a generally cylindrical insulating casing defining a highly-evacuated envelope;
b. a pair of relatively movable conductive contact posts sealingly extending through opposed ends of the envelope along the longitudinal axis of the cylindrical insulating casing;
c. arc contact members disposed at the ends of the respective contact posts within the space defined by the cylindrical insulating casing;
d. a single centrally disposed metallic condensing shield supported from the cylindrical insulating casing and centrally disposed within the space defined by the cylindrical insulating casing about the arc contacts and the gap between the contacts when they are spaced apart to shield the insulating casing from vaporized metal from the contacts;
e. a resistive coating disposed on the interior or exterior surface of the insulating casing and electrically contacting the centrally disposed metallic condensing shield, which resistive coating extends to and serially electrically connects the condensing shield to at least one of the contact posts whereby the potential on the condensing shield may be quickly dissipated through the resistive coating.

2. The combination specified in claim 1, wherein the resistive coating extends between the centrally disposed metallic condensing shield and each of the contact posts.

3. The combination specified in claim 1, wherein a conductive support flange extends from the exterior surface of the condensing shield, which flange extends to and is supported by the insulating casing with the resistive coating contacting the support flange.

4. The combination specified in claim 3, wherein the conductive support flange sealingly extends through the insulating casing and the resistive coating is disposed on the exterior surface of the insulating casing contacting the flange.

5. The combination specified in claim 1, wherein the resistive coating has a resistance value of from $10^{6}$ to $10^{12}$ ohms.

6. The combination specified in claim 1, wherein when the resistive coating extends between the condensing shield and only one contact post, the resistive reactance is greater than the capacitive reactance between the condensing shield and the contact.

7. The combination specified in claim 1, wherein the resistive coating is silicon carbide.

* * * * *